US007892991B2

(12) United States Patent
Yamanaka et al.

(10) Patent No.: US 7,892,991 B2
(45) Date of Patent: Feb. 22, 2011

(54) ELASTIC NETWORK STRUCTURE

(75) Inventors: Masaki Yamanaka, Shiga (JP); Yoshihiro Matsui, Osaka (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 261 days.

(21) Appl. No.: 11/722,265

(22) PCT Filed: Dec. 20, 2005

(86) PCT No.: PCT/JP2005/023331

§ 371 (c)(1),
(2), (4) Date: Jun. 20, 2007

(87) PCT Pub. No.: WO2006/068120

PCT Pub. Date: Jun. 29, 2006

(65) Prior Publication Data

US 2008/0146763 A1 Jun. 19, 2008

(30) Foreign Application Priority Data

Dec. 21, 2004 (JP) ..... 2004-369020
Dec. 21, 2004 (JP) ..... 2004-369021
Dec. 21, 2004 (JP) ..... 2004-369022
Dec. 21, 2004 (JP) ..... 2004-369023

(51) Int. Cl.
*D04H 3/03* (2006.01)
*D04H 3/07* (2006.01)
*D04H 3/14* (2006.01)
*D04H 3/16* (2006.01)

(52) U.S. Cl. ..... 442/328; 442/409

(58) Field of Classification Search ..... 442/328, 442/327, 409, 401, 329; 428/86
See application file for complete search history.

(56) References Cited

U.S. PATENT DOCUMENTS 3,936,337 A 2/1976 Stapp
4,012,249 A 3/1977 Stapp
4,227,350 A * 10/1980 Fitzer ..... 51/295
4,913,757 A * 4/1990 Yamanaka et al. ..... 156/167
5,183,708 A 2/1993 Yoshida et al.
5,346,757 A * 9/1994 Nakata ..... 428/88
5,427,845 A * 6/1995 Sawyer et al. ..... 442/346
5,464,491 A * 11/1995 Yamanaka ..... 156/167
5,476,563 A * 12/1995 Nakata ..... 156/167
6,347,790 B1 * 2/2002 Nishibori et al. ..... 267/148
7,377,762 B2 * 5/2008 Nishibori et al. ..... 425/71
2008/0146763 A1 * 6/2008 Yamanaka et al. ..... 526/352.2

FOREIGN PATENT DOCUMENTS

| | | |
|---|---|---|
| EP | 1 270 787 | 1/2003 |
| GB | 1 269 108 | 4/1972 |
| GB | 2 214 941 | 9/1989 |
| JP | 47-44839 | 12/1972 |
| JP | 58-136828 | 8/1983 |
| JP | 60-11352 | 1/1985 |
| JP | 61-137732 | 6/1986 |
| JP | 61-141388 | 6/1986 |
| JP | 61-141391 | 6/1986 |
| JP | 03-249213 | 11/1991 |
| JP | 04-245965 | 9/1992 |
| JP | 07-238458 | 9/1995 |
| JP | 11-29904 | 2/1999 |
| JP | 11-138613 | 5/1999 |
| JP | 2002-194655 | 7/2002 |
| JP | 2003-250667 | 9/2003 |
| WO | WO 91/19032 | 12/1991 |

* cited by examiner

*Primary Examiner*—Cheryl Juska
(74) *Attorney, Agent, or Firm*—Fish & Richardson P.C.

(57) ABSTRACT

Provided is an elastic network structure having durability and cushioning properties suitable for furniture, bedding such as a bed, seats for vehicles, seats for shipping, etc., the network structure being lightweight and having excellent chemical resistance, excellent light resistance, soft repellency, and excellent cushioning characteristics in a low temperature environment. The elastic network structure comprises a three-dimensional random loop bonded structure obtained by forming random loops with curling treatment of a continuous linear structure having not less than 300 decitex, and by making each loop mutually contact in a molten state to weld the majority of contacted part, the continuous linear structure mainly including a low density polyethylene resin with a specific gravity of not more than 0.94 g/cm$^3$.

19 Claims, 1 Drawing Sheet

ELASTIC NETWORK STRUCTURE

TECHNICAL FIELD

The present invention relates to an elastic network structure having durability and cushioning properties suitable for furniture, bedding such as a bed, seats for vehicles, seats for shipping, etc., the elastic network structure being lightweight and having excellent chemical resistance, excellent light resistance, soft repellency, and excellent cushioning characteristics in a low temperature environment.

BACKGROUND ART

At present, foamed urethanes, non-elastic crimped staple stuffing, and resin-like stuffing, hard stuffing, etc. obtained by bonding of non-elastic crimped staples are used as a cushioning material for furniture, bedding such as a bed, trains, and automobiles.

However, although foamed-crosslinking type urethanes have excellent durability as a cushioning material, they have inferior moisture and water permeability, and thermal storage property to exhibit possible humid feeling. Since the foamed-crosslinking type urethanes do not have thermoplasticity, they have difficulty in recycling, and they give significant damage to incinerators in case of incineration, and need high costs in elimination of poisonous gas. For this reason, the foamed-crosslinking type urethanes are often used for reclamation, but limitation of reclamation spot based on difficulty of stabilization of ground causes problems of the necessity for higher costs. Furthermore, although the foamed-crosslinking type urethanes have excellent workability, they may cause pollution problems with chemicals that have been used in a manufacturing process. Since fibers are not fixed with each other in thermoplastic polyester bonded stuffings, deformation of shape in use, movement of fibers, and wear-out of crimp, and problems of fall of bulkiness and elasticity will occur.

Examples include resin-like stuffing obtained by adhesion of polyester fibers with adhesives, for example, a resin-like stuffing using a rubber based adhesive as adhesives (for example, refer to Patent Documents 1, 2, and 3), and a stuffing using a crosslinking type urethanes as adhesives (for example, refer to Patent Document 4.) These cushioning materials have inferior durability, and do not exhibit thermoplasticity, nor have single composition. For these reasons, they may cause a problem of impossibility of recycling, and complicated workability, problems of pollution with chemicals used in a manufacturing process etc.

In examples (for example, refer to Patent Documents 5, and 6) that use polyester hard stuffings, since the fiber component of the thermally fusible fiber uses an amorphous brittle polymer, the hard stuffing has a problem that a brittle bonded part will be easily broken in use to result in poor durability of deformation and deterioration of elasticity.

Although a method of intermingling treatment (for example, refer to Patent Document 7) is proposed as an improving method, a problem of brittleness of the bonded part is not yet solved, resulting in a great problem of deterioration of elasticity. In addition, the method also has complicated workability, and furthermore has a problem of difficulty in deformation of the bonded part, leading to inferiority in soft cushioning property. For this reason, proposed is a cushioning material utilizing a thermally fusible fiber using a soft polyester elastomer having recoverability from deformation in a part to be bonded (for example, refer to Patent Document 8). A polyester elastomer, serving as an bonding component, used for this fiber structure, includes 50 to 80 mol % of terephthalic acid in an acid component of a hard segment, and includes 30 to 50% by weight, as a content, of a polyalkylene glycol as a soft segment, in order to obtain a lower melting point. The polyester elastomer includes, as other acid component, isophthalic acid etc. to increase amorphous property and to give a melting point not more than 180° C. and a lower melt viscosity, resulting in formation of excellent thermally bonded part and of an amoeba-like bonded part. However, since the polyester elastomer is a sheath-core type conjugated fiber using a polyethylene terephthalate in a core part thereof, it exhibits high repellency to cause a problem of difficulty in fitness along a human body. It also has a problem of higher costs caused by use of a compound spinning fiber and by necessity for process of melting bonding with reheating.

Although a thermoplastic olefin network structure used for civil engineering works is proposed (for example, refer to Patent Document 9), the structure has poor touch due to uneven surface thereof unlike cushions including thin fibers, and has inferior cushioning properties based on use of a linear olefin as a material. In addition, although a network structure using vinyl chloride is proposed for door mats etc., the structure exhibits easy deformation by compression and inferior recoverability. Furthermore, the structure produces poisonous hydrogen halides in combustion to prove to be unsuitable to cushioning materials.

As substitute of urethanes, also investigated is a cushioning material including a mixture of a polyolefin resin; and a vinyl acetate resin, a vinyl acetate ethylene copolymer, or a styrene styrene-butadiene rubber (for example, Patent Document 10). However, this cushioning material has problems of: less sinking as compared with urethanes; a high stress at 25% compression; a small stress difference between compressed state and decompressed state to give excessively high repellency; poor light resistance caused by mixing with other components; and heavy weight based on large specific gravity.

There has been proposed a three-dimensional random loop bonded structure obtained by forming random loops by curling treatment of continuous linear structure including a polyester thermoplastic elastic resin, and by making each loop mutually contact in a molten state to weld the majority of contacted parts. The above-described structure, however, generally has a specific gravity of not less than 1.3, and tends to be heavy, and also causes a problem of needing cautions, in manufacturing control and use, due to inferior chemical resistance. In addition, since polyester thermoplastic resins have a benzene ring in a principal chain thereof, they have comparatively inferior light resistance; they may cause a problem of deterioration of elastic recoverability, in the case of use in environment exposed to sunlight, for a long period of time. And, since excessively larger recoverability exhibits excessively stronger repulsive force, in structures that use a polyester thermoplastic resin, the above-described structures give deformation along with human body, but they exhibit a large pressure difference between a portion with sufficient sink, and a portion with less sink, causing a problem of fatigue with long-time use. Furthermore, when a glass transition temperature is set in a lower temperature side by variation of a copolymerization ratio of polyester thermoplastic resins, softness will be increased, but conversely elastic recoverability significantly deteriorates, causing a problem of failure of fulfilling the function as a cushioning material.

Patent Document 1: Japanese Patent Publication No. S60-11352 A

Patent Document 2: Japanese Patent Publication No. S61-141388 A

Patent Document 3: Japanese Patent Publication No. S61-141391 A

Patent Document 4: Japanese Patent Publication No. S61-137732 A

Patent Document 5: Japanese Patent Publication No. S58-136828 A

Patent Document 6: Japanese Patent Publication No. H03-249213 A

Patent Document 7: Japanese Patent Publication No. H04-245965 A

Patent-Document 8: WO 91/19032

Patent Document 9: Japanese Patent Publication No. S47-44839 A

Patent Document 10: Japanese Patent Publication No. 2003-250667 A

DISCLOSURE OF INVENTION

Figure 1:
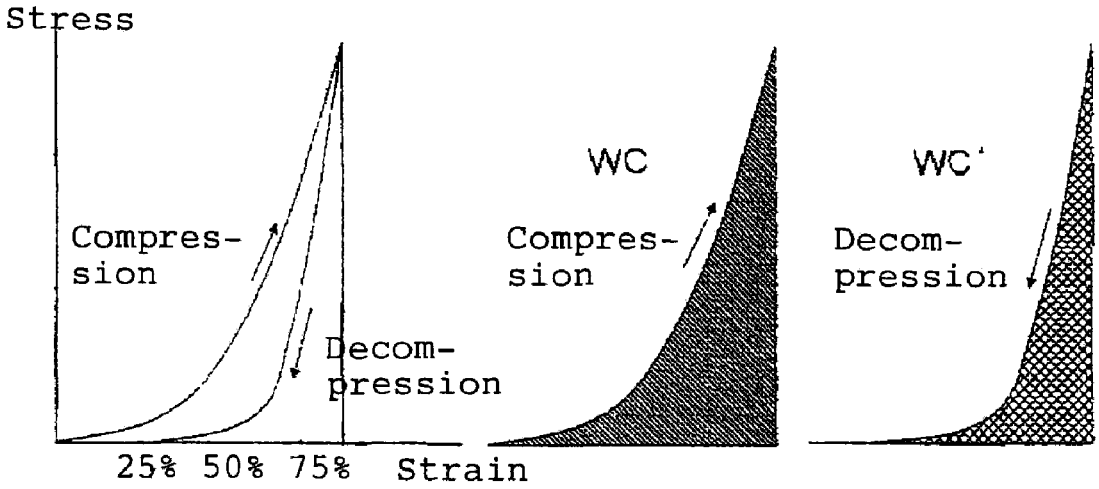
FIG. 1 illustrates a schematic graph of compression/decompression test in elastic network structure of the present invention.

Problems to be Solved by the Invention

The present invention has been completed in consideration of problems of conventional technology, and aims at providing an elastic network structure having excellent durability and cushioning properties and avoiding stuffy feeling, the network structure being lightweight and having excellent chemical resistance and light resistance, soft repellency, and excellent cushioning characteristics in a low temperature environment, a continuous linear structure mainly including a low density polyethylene resin having a specific gravity of not more than 0.94.

Means for Solving Problem

The present invention has been completed as a result of wholehearted investigation performed by the present inventors in order to solve the above-described problems. That is, the present invention includes:

1. An elastic network structure comprising a three-dimensional random loop bonded structure obtained by forming random loops with curling treatment of a continuous linear structure having not less than 300 decitex, and by making each loop mutually contact in a molten state to weld most contacted parts, the continuous linear structure mainly including a low density polyethylene resin with a specific gravity of not more than 0.94.
2. The elastic network structure according to the above-described item 1, wherein the network structure has an apparent density of 0.005 to 0.2 g/cm$^3$.
3. The elastic network structure according to the above-described items 1 or 2, wherein compressive strain retention after light resistance test by a carbon arc lamp is not less than 60%.
4. The elastic network structure according to any one of the above-described items 1 to 3, wherein a hysteresis loss is from 35% to 70%.
5. The elastic network structure according to any one of the above-described items 1 to 4, wherein a 25%-compression hardness at 0° C. of the network structure is not more than 150% compared with a 25%-compression hardness at 20° C.
6. The elastic network structure according to any one of the above-described items 1 to 5, wherein a 50%-compression hardness at 0° C. of the network structure is not more than 150% compared with a 50%-compression hardness at 20° C.
7. The elastic network structure according to any one of the above-described items 1 to 6, wherein a diameter of a random loop is not more than 50 mm.
8. The elastic network structure according to any one of the above-described items 1 to 7, wherein a thickness of the network structure is not less than 3 mm.
9. The elastic network structure according to any one of the above-described items 1 to 8, wherein the elastic network structure is used for cushions.

Effect of the Invention

Since the continuous linear structure in an elastic network structure according to the present invention mainly includes a low density polyethylene resin with a specific gravity of not more than 0.94, the continuous linear structure can provide a lightweight elastic network structure having little restriction in handling or usage, excellent chemical resistance, excellent light resistance, and soft repellency, and furthermore outstanding cushioning characteristics in a low temperature environment.

BEST MODE FOR CARRYING OUT OF THE INVENTION

Hereinafter, the present invention will be described in detail. The elastic network structure in the present invention is defined as an elastic network structure having an elastic recovery rate of not less than 95% measured in a test of 75% compression and decompression. The elastic recovery rate is preferably not less than 97%, and more preferably not less than 98%. Since an elastic network structure made of conventional substantially linear polyethylenes and polypropylenes has an elastic recovery rate of approximately 80% to provide an approximately 20% of strain, this elastic network structure is not included in the elastic network structure of the present invention.

The elastic network structure according to the present invention forms a network structure including three-dimensional random loops by forming a large number of loops by curling treatment of a continuous linear structure, with not less than 300 decitex, mainly including a thermoplastic resin, and by making each loop mutually contact in a molten state to weld the majority of contacted parts. Thereby, even in case of application of a large deformation based on a very large stress, whole of a network structure including three-dimensional random loops obtained by mutual welding and integration will deform to absorb a stress. Furthermore, when the stress is removed, the structure can recover an original shape thereof with progress of a short period of time. In case of use, as a cushioning material, of a network structure formed with a continuous linear structure including publicly known resins, such as polyesters, polyamides, linear polyolefines, etc., when the continuous linear structure has a greater fineness or the network structure has a higher apparent density, the network structure likely fails to demonstrate cushioning properties. Even if the network structure allows demonstration of cushioning properties, it will give plastic deformation or will cause breakage of structure, resulting in almost no recovery. In case of absence of welding, since the structure cannot maintain the shape, and can not integrally deform, it causes fatigue phenomenon by stress concentration to exhibit poor durability, disadvantageously causing deformation of shape, so the network structure free of welding is not preferable. Amore desirable state of welding of the present invention is a state wherein all contacting parts are welded together.

In addition, since the fineness of not more than 300 decitex of the continuous linear structure of the present invention reduces the strength and the repulsive force, it is not preferable. Preferable fineness for providing repulsive force of the continuous linear structure of the present invention is not less than 400 decitex and not more than 100000 decitex. The fineness of not less than 100000 decitex decreases composing number of the linear structure, and deteriorates compression characteristics, leading to limitation of usable part. The fineness is more preferably from 500 to 50000 decitex. Cross section shape is not particularly limited, and use of a modified cross section or a hollow cross section is preferable because it improves the repulsive force, in use of continuous linear structure with finer fineness.

When a three-dimensional random loop bonded structure of continuous linear structure is not used, that is, for example, an adhered structure obtained by heat treatment of a stuffing structure including a mixed staple fiber of a conjugated fiber using a lower melting point polymer for a sheath and an adhesive fiber can provide bonding in the shape of an amoeba with balanced spread and directionality of fiber in two dimensions. However, it hardly has fibers aligned in a thickness direction, and cannot use recovering power in the fiber axial direction, only utilizing recovering power in a shear direction. It exhibits elasticity as in a planar object, like spring deformation proportional to square of displacement, disadvantageously resulting in a large force of repulsion. Therefore, the adhered structure is not preferable.

The continuous linear structure including the thermoplastic resin for forming the elastic network structure of the present invention may have a compounded shape obtained by combination with other thermoplastic resins in the range without impairing the objective of the present invention. The compounded shape includes a sheath core type, a side by side type, an eccentric sheath core type, etc. in the case of compounding of linear structure itself.

Examples obtained by compounding (integrated bonded structure) of elastic network structure layers include a sandwiched structure of elastomer layer/non-elastomer layer/elastomer layer; a two-layered structure of elastomer layer/non-elastomer layer; and a compounded structure by partially disposing a non-elastomer layer inside of an elastomer layer of matrix.

The elastic network structure of the present invention may be obtained by suitably selecting network structures, such as structures having different loop size from each other, structures having different fineness from each other, structures having different composition from each other, structures having different density from each other etc. and by laminating or mixing them together based on performance needed.

Furthermore, the present invention comprises a method of obtaining cushions for seats by disposing a thermally bonding layer (low melting point thermally bonding fiber or low melting point thermally bonding film) on the surface of the laminated structure if necessary, and by integrally bonding a side part and a wadding layer, and comprises a method of obtaining cushions by using a hard wadding cushion (a cushion preferably including thermally bonding fiber of elastomer) in combination as a wadding layer and by integrally thermally bonding a side part.

The polymer for forming the elastic network structure of the present invention is preferably a low density polyethylene resin having a specific gravity of not more than 0.94, and especially preferably it includes an ethylene-a-olefin copolymer resin including ethylene and an α-olefin with carbon number of not less than 3. The ethylene-α-olefin copolymer of the present invention is preferably a copolymer described in Japanese Patent Publication No. H06-293813 A, and this is obtained by copolymerizing ethylene and an α-olefin with a carbon number of not less than 3. Here, the α-olefin having a carbon number of not less than 3 includes, for example: propylene, butene-1, pentene-1, hexene-1, 4-methyl-1-pentene, heptene-1, octene-1, nonene-1, decene-1, undecene-1, dodecene-1, tridecene-1, tetradecene-1, pentadecene-1, hexadecene-1, heptadecene-1, octadecene-1, nonadecene-1, or eicosene-1 etc. Preferably the α-olefin is butene-1, pentene-1, hexene-1, 4-methyl-1-pentene, heptene-1, octene-1, nonene-1, decene-1, undecene-1, dodecene-1, tridecene-1, tetradecene-1, pentadecene-1, hexadecene-1, heptadecene-1, octadecene-1, nonadecene-1, or eicosene-1In addition, two or more of the above-mentioned α-olefins may be used in combination. Usually, α-olefin is to be copolymerized in an amount of 1 to 40% by weight.

This copolymer may be obtained by copolymerization of ethylene and the α-olefin using a catalyst system including a specific metallocene compound and an organometallic compound as a basic composition.

Use of raw materials having a specific gravity exceeding 0.94 g/cm$^3$ hardens the obtained cushioning material, so it is not preferable. The specific gravity is more preferably not more than 0.935 g/cm$^3$, and still more preferably not more than 0.93 g/cm$^3$. From a viewpoint of retention of hardness, a lower limit value is not less than 0.8 g/cm$^3$, and preferably not less than 0.85 g/cm$^3$.

This copolymer preferably has thermal fusibility. Thermal fusibility enables recycling by re-melting, leading to easy recycling.

A lower limit value of the apparent density of the elastic network structure of the present invention is not less than 0.005 g/cm$^3$, more preferably not less than 0.007 g/cm$^3$, and still more preferably not less than 0.01 g/cm$^3$. An upper limit value is not more than 0.2 g/cm$^3$, more preferably not more than 0.1 g/cm$^3$, and still more preferably not more than 0.08 g/cm$^3$. The apparent density of less than 0.005 g/cm$^3$ fails to provide repulsive force, and the elastic network structure is unsuitable as a cushioning material, and the apparent density exceeding 0.2 g/cm$^3$ gives great elasticity, and reduces comfortableness, leading to an unsuitable cushioning material.

In light resistance test by carbon-arc lamp, the elastic network structure of the present invention has a compressive strain retention of not less than 60%, preferably not less than 75%, and more preferably not less than 85%. The elastic network structure preferably maintains the original network structure thereof after 500-hour exposure test by carbon-arc lamp. It is generally believed that exposure of 500 hours by carbon-arc lamp gives the amount of UV irradiation equivalent to a case where a sample is kept standing outdoors for one year. Taking in recycling efficiency into consideration, some products have been developed, wherein an elastic network structure without other materials mixed therein is used without covering thereon. In this case, conventional copolymerized polyesters and copolymerized polyamides have problems of easy loss of cushioning properties or easy yellowing by exposure in outdoor environment. The elastic network structure of the present invention can solve this problem by preferably using polyethylene resins.

The elastic network structure of the present invention preferably has hysteresis loss of not less than 35% and not more than 70%. A large hysteresis loss represents that the power of return after release of stress is weak, and for example, when a body weight is applied to the structure, uniform power will be given, leading to effect of less tiredness. Since hysteresis of loss less than 35% produces a large recovering power, soft repellency as an object of the present invention will not be given, so it is not preferable. Hysteresis loss exceeding 70% disadvantageously fails to give sensible elasticity, so also is not preferable. The hysteresis loss is preferably 40 to 60%, and more preferably 45% to 55%. Since copolymerized polyesters give lower stress in stress strain curve on the whole, they fail to provide a larger hysteresis loss.

A 25%-compression hardness at 0° C. of the elastic network structure of the present invention is preferably not more than 150% as compared with a 25%-compression hardness at 20° C., more preferably not more than 140%, still more preferably not more than 130%. The elastic network structure of the present invention is characterized by exhibiting moderate elasticity also at low temperatures. Publicly known elastic network structures include polyester copolymers as a main constituent. They are designed to exhibit moderate elasticity at ordinary temperatures (20 to 30° C.), but they exhibit inferior cushioning properties at around 0° C. The compression hardness that especially represents a stress of 25% compression shows a feeling at the time of commencement of application of a body weight in case of use as a cushioning material, and therefore it is an index that greatly influences image of softness of the cushioning structure. Discomfort of feeling becomes significant, when the compression hardness at low temperatures increases by a value of not less than 50% with respect to the compression hardness at ordinary temperatures, so it is not preferable.

A 50%-compression hardness at 0° C. of the elastic network structure of the present invention is preferably not more than 150% as compared with a 50%-compression hardness at 20° C., more preferably not more than 140%, and still more preferably not more than 130%. The compression hardness that represents a stress of 50% compression shows a feeling during application of a body weight in case of use as a cushioning material. Increase by a value of not less than 50% of a compression hardness at low temperatures with respect to a compression hardness at ordinary temperatures exhibits excessive hardness, making the elastic network structure unsuitable as a cushioning material.

The elastic network structure of the present invention has a diameter of random loops of not more than 50 mm, more preferably not more than 40 mm, and still more preferably not more than 30 mm. The diameter of the random loops of more than 50 mm extends loops in a thickness direction, and easily gives variation of void ratio, leading to possible unevenness of cushioning properties.

The elastic network structure of the present invention has a thickness of not less than 3 mm, more preferably not less than 10 mm, and still more preferably not less than 20 mm. A thickness of less than 3 mm makes a stroke of deformation excessively small, resulting in easy bottoming feeling, so is not preferable. In consideration of manufacturing apparatus, an upper limit value is not more than 300 mm, preferably not more than 200 mm, and more preferably not more than 150 mm.

The elastic network structure of the present invention is preferably used for cushions. In use of the elastic network structure of the present invention for cushioning materials, resins, fineness, diameter of loops, and bulk density to be used need to be selected based on purposes of use and parts for use. For example, when using for surface wadding, a finer fineness and a finer diameter of loops with a lower density are preferably used in order to exhibit bulkiness having soft touch, moderate sinking, and tension. In use as a middle portion cushioning body, a density of middle degree, a thicker fineness, and a little larger diameter of loops are preferred, in order to exhibit an excellent lower frequency of sympathetic vibration, a moderate hardness, good retention capacity of form by linear variation of hysteresis in compression, and to maintain durability. Furthermore, the elastic network structure may be molded into a form suitable for the purpose of use with a molding die etc. within a range that does not impair a three-dimensional structure, and then may be covered with a side part to be used for seats for vehicles, seats for shipping, beds, chairs, furniture etc. Of course, in order to make needed performance suitable for according usage, the elastic network structure may also be used with other stuffings, for example, combination with hard stuffings cushioning materials including staple fiber packed materials, and nonwoven fabrics. Furthermore, in any stages of processing into molded objects from manufacturing process of the polymer to be used, there may be given treatment processing of chemicals addition for functions of flame-resistance, insect control antibacterial treatment, heat-resistance, water and oil repelling, coloring, fragrance, etc.

Hereinafter, the processes of the present invention will be described. In the present invention, for example, a thermoplastic resin obtained by publicly known methods, such as Japanese Patent Application No. S55-120626 A, is molten using a common melt extruder, and is heated and maintained at a temperature 10 to 80° C. higher than the melting point thereof. The molten resin is extruded out downward through a nozzle with two or more orifices, forming loops with free-fall. At this point, a distance between a nozzle face and a take-up conveyor disposed over a cooling medium for solidification of the resin, a melt viscosity of the resin, a hole size of an orifice, and an amount of discharge etc. determine a diameter of loops, and a fineness of the linear structure. A pair of take-up conveyors, having an adjustable gap, disposed over the cooling medium sandwich the discharged linear structure in a molten state, and hold the linear structure to form loops. By adjusting the gap of holes of the orifice as a gap of hole allowing contact of the formed loops, the formed loops are mutually contacted, and thereby the contacted portion mutually welds, while forming random three-dimensional loops. Subsequently, the continuous linear structure obtained by mutual welding of the contacted parts, while forming random three-dimensional shape, is continuously introduced into the cooling medium, and solidified, forming a network structure. Then, the network structure is cut into a desired length and shape, laminated, and molded, if needed, to be used for cushioning materials. In the present invention, the thermoplastic resin is heated at temperatures 10 to 80° C. higher than a melting point thereof and kept in a molten state, and then is extruded downward from a nozzle with two or more orifices. The thermoplastic resin at a temperature higher than the melting point thereof by a difference of less than 10° C. allows the extruded linear structure to be cooled and makes the flow thereof difficult, resulting in insufficient welding of the contacted part of the linear structure, so is not preferable. On the other hand, the thermoplastic resin molten at a temperature higher than the melting point by a difference of more than 80° C. excessively decreases the melt viscosity of the thermoplastic resin, and impairs the stability of the diameter of the random loop, making the formation of a three-dimensional shape difficult, so is also not preferable. Since adjustment of the melt temperature in discharging at a temperature 30 to 50° C. higher than the melting point of the thermoplastic resin allows maintenance of a comparatively higher melt viscosity and formation of excellent loops, leading to easier formation of a random three-dimensional shape and to maintenance of a state of easy welding of the contacted part, so is preferable.

Preferable embodiments in the method of the present invention include a method of adjusting the temperature of the cooling medium at temperatures for annealing approximately 20° C. in order to form a network structure by continuously introducing a continuous linear structure having welded contacted parts into a cooling medium to be solidified while forming a random three-dimensional shape.

The diameter of loops and the fineness of the linear structure of the continuous linear structure constituting the network structure for cushions of the present invention is determined based on a distance between a nozzle face and a take-up conveyor disposed over the cooling medium for solidification of the resin, a melt viscosity of the resin, a pore size of the orifice, the amount of discharge of the resin, etc. For example, conditions of decrease of the amount of discharge of the thermoplastic resin and deterioration of the melt viscosity in discharge make the fineness of the linear structure finer, and also make the average-loop diameter of the random loops smaller. A shorter distance between the nozzle face and the take-up conveyor disposed on the cooling medium for solidification of the resin will provide a little coarser fineness of the linear structure and will also enlarge the average loop diameter of the random loops. With combination of such conditions, the fineness of continuous linear structure is preferably adjusted in a range of 500 decitex to 50000 decitex, and the average diameter of the random loop is not more than 50 mm, more preferably 2 mm to 25 mm. Adjustment of the gap of the above-mentioned conveyor enables control of a thickness while welded network structure is in a molten state, and furthermore, can produce flattened and sandwiched face having a desired thickness. An excessively large conveyor velocity cools the network structure before welding, and makes welding of the contacted part impossible. Furthermore, since an excessively small velocity extends the residence period of the fused material and increases the density, the gap of the conveyor and the conveyor velocity are preferably set in order to give a desired apparent density of the present invention. The network structure of the present invention obtained in this way has excellent soft repellency that has not been found in cushioning materials including packed materials of conventional staple fiber in use as cushioning materials. Although preferable examples have been described as mentioned above, the present invention is in no way limited to them.

Although the present invention will be described in detail with reference to examples, the present invention is in no way limited to them. Measurement and evaluation of characteristic values in examples were performed by following methods.

(1) Fineness

A specimen was cut into a size of 20 cm×20 cm, and sample was taken from 10 places. The linear structures sampled at 10 places were measured for a specific gravity at 40° C. using a density gradient tube. Furthermore, the linear structure sampled at the above-mentioned 10 places was measured for a cross-section area in a photograph magnified by 30 times under microscope to calculate a volume for a 10000 m of length of the linear structure. The product of a specific gravity and the volume obtained represents fineness (weight for 10000 m of the linear structure). (Average of n=10)

(2) Welding

Whether the sample was welded or not was judged by visual judgment, and a state where bonded part could not be separated by pulling by hands was judged to be welded.

(3) Evaluation of compressive strain retention and photodegradation after light resistance test by carbon arc light Two samples cut out from a specimen in a size of 20 cm×20 cm were prepared. One of the samples was compressed to 50% of a thickness with ϕ150 compression board by a tensilon produced by Orientex corp., and held in the state for 24 hours. The sample after kept standing for 21 hours was measured for a thickness (a), after release of compression. Another sample was subjected to irradiation for 10 hours using a sunshine weatherometer, according to method A of JIS L 0843, under conditions with an irradiance 38.5 W/m$^2$ (300 nm to 400 nm) and an irradiation temperature of 63±30° C. The irradiated sample was subjected to the same compression test, and a thickness (b) after kept standing for 21 hours, after release of compression was obtained with a following equation.

$$\text{Compressive strain retention}=(b/a)\times 100\text{: unit \% (average of } n=3)$$

Furthermore, in photodegradation evaluation, irradiation was given to a sample cut by a size of 7 cm×15 cm under the same irradiation conditions as in the above described evaluation for 500 hours. Whether the network structure was maintained was evaluated according to following criteria.

Good: Original network structure maintained.

Poor: Network structure not maintained to give deformation.

(4) Sample Thickness and Apparent Bulk Density

A specimen was cut into a size of 15 cm×15 cm, the cut sample was kept standing without load for 24 hours, and then the sample was measured for a thickness at 4 points to obtain an average value as a sample thickness. A volume was calculated from the thickness of the sample. A value of the weight of the sample divided with a volume represents an apparent bulk density. (Average of n=4, respectively)

(5) Average Diameter of Random Loop

A specimen was cut in a size of 20 cm×20 cm, and was obtained an average diameter of an inscribed circle and a circumscribed circle of a loop drawn to a 360 degrees rotating point of a random loop having irregular shape formed in a longitudinal direction. (Average of n=20)

(6) Elastic Recovery Rate

A specimen was cut in a size of 20 cm×20 cm, and was kept standing in an environment at 20° C. for 1 hour. Using a tensilon produced by Orientex corp. in an environment at 250° C., the sample was compressed by 75% with a ϕ150 mm compression board at a speed of 50 mm/min. Without hold time, the compression board was returned to the original position at the same velocity, and then an elastic recovery rate of was obtained by following equation using a thickness before compression (a) and a thickness (b) after compression and decompression.

$$\text{Elastic recovery rate (\%)}=(b/a)\times 100$$

(7) 25%- or 50%-Compression Hardness at 20° C.

A specimen was cut in a size of 20 cm×20 cm, and kept standing with no load for 24 hours, and then was kept standing for 1 hour in an environment at 20° C. Using a tensilon produced by Orientex corp. in an environment at 25° C., the sample was compressed by 25% or 50% with a ϕ150 mm compression board at a speed of 50 mm/min, and a load was measured. (Average of n=3)

(8) 25%- or 50%-Compression Hardness at 0° C.

A specimen was cut in a size of 20 cm×20 cm, and kept standing with no load for 24 hours, and then was immersed in iced water for 1 hour. Within 3 minutes, the sample was compressed by 25% or 50% at a speed of 50 mm/min. with a ϕ150 mm compression board that had been immersed into iced water for 1 hour, using a tensilon produced by Orientex corp. in an environment at 20° C., and a load was measured. (Average of n=3)

(9) Hysteresis Loss

A specimen was cut in a size of 20 cm×20 cm, and the cut sample was kept in an environment at 20° C. for 1 hour. Using a tensilon produced by Orientex corp. in an environment at 25° C., the sample was compressed by 75% with a ϕ150 mm compression board at a speed of 50 mm/min. Without hold time, the compression board was returned to the original position at the same velocity (the first stress strain curve), and subsequently, the same process was repeated without hold time (compression and return) (the second stress strain curve). A compression energy given by a stress curve at the second compression was represented with (WC), and a compression energy given by a stress curve at the second decompression was represented with (WC'). Hysteresis loss was calculated according to following equation.

$$\text{Hysteresis loss (\%)}=((WC-WC')/WC)\times 100$$

WC=∫PdT (a workload at compression from 0% to 75%)

WC'=∫pdT (a workload at decompression from 75% to 0%)

In a simplified manner, when a stress strain curve as in FIG. 1 is obtained, an area drawn in oblique lines is defined as WC, and an area drawn in net-like lines is defined as WC'. Each area of a paper with each curve drawn thereon is cut out to be measured for a weight, and the target value may be obtained from each of the weight. (Average of n=3)

EXAMPLE

Example 1

Using a metallocene compound as a catalyst, hexane, hexene, and ethylene were polymerized by a publicly known method. The obtained ethylene-α-olefin copolymer (specific gravity 0.919) was melted. The molten copolymer raw material was discharged in an amount of 0.7 g/min per single hole through orifices, each having a hole size of 0.5 mm, disposed at a pitch between holes of 5 mm in an nozzle surface area of 50 cm in width, and 5 cm in length. Cooling water was arranged at a position 250 cm under the nozzle face. Endless nets made from stainless steel having a width of 60 cm were disposed parallel in an interval of 50 mm to form a pair of take-up conveyors, partially exposed over a water surface. The copolymer raw material extruded was taken up on this conveyor, while being welded on the contacted parts, and sandwiched from both sides. The sandwiched material was introduced into water at 25° C. with a speed of 1.0 m/min. to be solidified, and then cut into a predetermined size, obtaining a network structure. Table 1 illustrates characteristics of the obtained network structure having flattened faces.

Example 2 to Example 6

Except having changed the amount of discharge through single hole, the take-up speed, the pitch between holes, the distance between nozzle face and cooling water, and the gap between endless nets as illustrated in Table 2, processes were performed in the same manner as in Example 1 to obtain network structures having the physical properties in Table 1.

Comparative example 1

Except for having used a polyether ester block copolymer elastomer (specific gravity 1.15) obtained by dimethyl terephthalate, dimethyl naphthalate, 1,4-butanediol, and polytetramethylene glycol, instead of ethylene-α-olefin copolymer, processes were performed in the same manner as in Example 1. Table 1 illustrates the characteristics of the network structures.

Comparative example 2

Except for having used a polypropylene (specific gravity 0.91) instead of the ethylene-α-olefin copolymer, processes were performed in the same manner as in Example 1. Table 1 illustrates the characteristics of the network structure.

TABLE 1

| | Elastic recovery rate (%) | Fineness (dtex) | Apparent density (g/cm$^3$) | Compression hardness retention after light resistance test (%) | Hysteresis loss (%) | 25% compression hardness ratio at 0° C./at 20° C. | 50% compression hardness ratio at 0° C./at 20° C. | Random loop diameter (mm) | Thickness (mm) | Photo-degradation evaluation | Overall evaluation |
|---|---|---|---|---|---|---|---|---|---|---|---|
| Example 1 | 99 | 3500 | 0.04 | 92 | 48 | 105 | 105 | 8.3 | 50 | Good | Excellent |
| Example 2 | 99 | 3700 | 0.03 | 79 | 49 | 106 | 106 | 9.9 | 100 | Good | Good |
| Example 3 | 99 | 3000 | 0.008 | 78 | 52 | 103 | 104 | 10.2 | 90 | Good | Good |
| Example 4 | 99 | 2500 | 0.02 | 82 | 55 | 103 | 103 | 1.2 | 30 | Good | Fair |
| Example 5 | 99 | 8000 | 0.18 | 93 | 60 | 107 | 109 | 5.3 | 50 | Good | Fair |
| Example 6 | 99 | 3000 | 0.07 | 97 | 45 | 109 | 112 | 2.7 | 9 | Good | Fair |
| Comparative Example 1 | 98 | 3500 | 0.04 | 55 | 32 | 165 | 170 | 8.1 | 50 | Poor | Poor |
| Comparative Example 2 | 70 | 3500 | 0.04 | 74 | 30 | 130 | 130 | 9.3 | 50 | Poor | Poor |

TABLE 2

| | Amount of discharge per single hole (g/min · H) | Taking up speed (m/min) | Pitch between nozzle holes (mm) | Distance between nozzle face-cooling water (cm) | Endless net gap (mm) |
|---|---|---|---|---|---|
| Example 1 | 0.7 | 1.0 | 5 | 250 | 50 |
| Example 2 | 1.0 | 1.9 | 5 | 250 | 100 |
| Example 3 | 0.6 | 1.0 | 10 | 250 | 90 |
| Example 4 | 0.1 | 0.5 | 2 | 250 | 30 |
| Example 5 | 1.4 | 1.0 | 5 | 250 | 50 |
| Example 6 | 0.3 | 0.5 | 2 | 250 | 9 |
| Comparative Example 1 | 0.7 | 1.0 | 5 | 250 | 50 |
| Comparative Example 2 | 0.7 | 1.0 | 5 | 250 | 50 |

INDUSTRIAL APPLICABILITY

Provided is a network structure having durability and cushioning properties suitable for furniture, bedding such as bed, seats for vehicles, seats for shipping, etc., the network structure being lightweight and having excellent chemical resistance, excellent light resistance, soft repellency, and excellent cushioning characteristics in a low temperature environment.

What is claimed is:

1. An elastic network structure having an elastic recovery rate of not less than 95% measured in a test of 75% compression and decompression and a hysteresis loss from 35% to 70%, the elastic network structure comprising a three-dimensional random loop bonded structure obtained by forming random loops with curling treatment of a continuous linear structure having not less than 300 decitex, and by making each loop mutually contact in a molten state to weld majority of contacted parts, the continuous linear structure mainly including an ethylene-α-olefin copolymer resin containing ethylene and an α-olefin with a carbon number of not less than 3, the ethylene-α-olefin copolymer resin having a specific gravity of not more than 0.94.

2. The elastic network structure according to claim 1, wherein the network structure has an apparent density of 0.005 to 0.2 g/cm$^3$.

3. The elastic network structure according to claim 1, wherein a compressive strain retention after light resistance test by a carbon arc lamp is not less than 60%.

4. The elastic network structure according to claim 1, wherein a 25%-compression hardness at 0° C. of the network structure is not more than 150% compared with a 25%-compression hardness at 20° C.

5. The elastic network structure according to claim 1, wherein a 50%-compression hardness at 0° C. of the network structure is not more than 150% compared with a 50%-compression hardness at 20° C.

6. The elastic network structure according to claim 1, wherein a diameter of a random loop is not more than 50 mm.

7. The elastic network structure according to claim 1, wherein a thickness of the network structure is not less than 3 mm.

8. The elastic network structure according to claim 2, wherein a compressive strain retention after light resistance test by a carbon arc lamp is not less than 60%.

9. The elastic network structure according to claim 8, wherein a 25%-compression hardness at 0° C. of the network structure is not more than 150% compared with a 25%-compression hardness at 20° C., and a 50%-compression hardness at 0° C. of the network structure is not more than 150% compared with a 50%-compression hardness at 20° C.

10. The elastic network structure according to claim 9, wherein a diameter of a random loop is not more than 50 mm, and a thickness of the network structure is not less than 3 mm.

11. The elastic network structure according to claim 1, wherein the ethylene-α-olefin copolymer resin has a specific gravity of not more than 0.935.

12. A cushion comprising an elastic network structure having an elastic recovery rate of not less than 95% measured in a test of 75% compression and decompression and a hysteresis loss from 35% to 70%, the elastic network structure comprising a three-dimensional random loop bonded structure obtained by forming random loops with curling treatment of a continuous linear structure having not less than 300 decitex, and by making each loop mutually contact in a molten state to weld majority of contacted parts, the continuous linear structure mainly including an ethylene-α-olefin copolymer resin containing ethylene and an α-olefin with a carbon number of not less than 3, the ethylene-α-olefin copolymer resin having a specific gravity of not more than 0.94.

13. The cushion according to claim 12, wherein the network structure has an apparent density of 0.005 to 0.2 g/cm$^3$.

14. The cushion according to claim 12, wherein a compressive strain retention after light resistance test by a carbon arc lamp is not less than 60%.

15. The cushion according to claims 12, wherein a 25%-compression hardness at 0° C. of the network structure is not more than 150% compared with a 25%-compression hardness at 20° C.

16. The cushion according to claim 12, wherein a 50%-compression hardness at 0° C. of the network structure is not more than 150% compared with a 50%-compression hardness at 20° C.

17. The cushion according to claim 12, wherein a diameter of a random loop is not more than 50 mm.

18. The cushion according to claim 12, wherein a thickness of the network structure is not less than 3 mm.

19. The cushion according to claim 12, wherein the ethylene-α-olefin copolymer resin has a specific gravity of not more than 0.935.

* * * * *